US006257115B1

(12) United States Patent
Balsavage et al.

(10) Patent No.: US 6,257,115 B1
(45) Date of Patent: Jul. 10, 2001

(54) MAGAZINE AND FEED MECHANISM FOR FIREARMS

(76) Inventors: Walter Balsavage, 222 Tantum Dr., Trenton, NJ (US) 08610; Richard E. McKee, 717 Yorketown Rd., Pilesgrove, NJ (US) 08098

( * ) Notice: Subject to any disclaimer, the term of this patent is extended or adjusted under 35 U.S.C. 154(b) by 0 days.

(21) Appl. No.: 09/367,145

(22) PCT Filed: Feb. 11, 1998

(86) PCT No.: PCT/US98/03396

§ 371 Date: Aug. 6, 1999

§ 102(e) Date: Aug. 6, 1999

(87) PCT Pub. No.: WO98/35199

PCT Pub. Date: Aug. 13, 1998

Related U.S. Application Data

(60) Provisional application No. 60/037,670, filed on Feb. 11, 1997.

(51) Int. Cl.[7] ..... F41A 9/00

(52) U.S. Cl. ..... 89/33.1; 89/33.03; 42/49.01; 42/39.5

(58) Field of Search ..... 42/49.01, 27, 9, 42/39.5; 89/33.01, 33.03, 33.1

(56) References Cited

U.S. PATENT DOCUMENTS

| | | | |
|---|---|---|---|
| 2,448,081 | 8/1948 | Conway | 42/17 |
| 2,624,241 | 1/1953 | Hill | 89/33 |
| 2,630,645 | 3/1953 | Olson | 42/17 |
| 2,773,325 | 12/1956 | Hill | 42/50 |
| 2,882,635 | 4/1959 | Hill | 42/17 |
| 3,997,994 | 12/1976 | Kastner et al. | 42/9 |
| 4,004,363 | 1/1977 | Sackenreuter et al. | 42/9 |
| 4,152,857 | 5/1979 | Ketterer | 42/88 |
| 4,286,499 | 9/1981 | Gillum | 89/33.01 |
| 4,348,941 | 9/1982 | Gillum | 89/155 |
| 4,524,672 | 6/1985 | Balsavage | 89/33.1 |
| 4,825,743 | 5/1989 | Balsavage | 89/33.1 |
| 5,610,362 | 3/1997 | Bouvard | 89/33.1 |

*Primary Examiner*—J. Woodrow Eldred
(74) *Attorney, Agent, or Firm*—Woodbridge & Associates, P.C.; Richard C. Woodbridge

(57) ABSTRACT

A magazine and compact feed mechanism for firearms includes an end cap on the magazine to keep cartridges from falling out and a stop mechanism for preventing a rotating cartridge transfer disk from traveling beyond 90°. The magazine is placed in a horizontal position so that it is parallel to the barrel and includes an end cap that is shaped to prevent cartridges from inadvertently falling out of the magazine. A spring-loaded cover may also be added to the magazine for further protection. Cartridges from the magazine are delivered to a rotatable transfer disk by an injector arm driven by the recoil of the slide mechanism. A rotatable cartridge transfer disk is also driven by the recoil of the slide mechanism and functions to receive the cartridge from the horizontal magazine and rotate it 90° so as to present it properly to the breech mechanism so that it can be presented to the barrel. In order to prevent the rotating transfer disk from traveling beyond 90°, as might be the case with high power ammunition, the slide and transfer disk include a mechanism to stop the transfer disk from rotating after precisely 90° of rotation.

9 Claims, 19 Drawing Sheets

130

132

134

136

132

134

200
204
206
208
210
210
202
212
214
216
218
220
222
24

204
206
208
212
218
220
214
222
216
24

204
206
208
218
220
222
216
214
215c
212
215d
215a
215b
24
226

MAGAZINE AND FEED MECHANISM FOR FIREARMS

CROSS REFERENCE TO RELATED APPLICATIONS

This application relates to, and claims the priority of, my U.S. Provisional Patent Application Ser. No. 60/037,670 filed on Feb. 11, 1997 and entitled "MAGAZINE AND FEED MECHANISM FOR FIREARMS AND OTHER APPLICATIONS", the entire substance and contents of which are hereby incorporated by reference into this application.

BACKGROUND OF THE INVENTION

1. Field of the Invention

The present invention generally relates to the field of firearms and, in particular, to firearms utilizing cartridges fed from a horizontal magazine and in which the cartridges are rotated 90° after delivery from the magazine so that they can be presented properly to the barrel prior to discharge.

2. Description of Related Art

Ammunition magazines are well known in the prior art. The vast bulk of such magazines, however, discharge the cartridges in a plane that is parallel to the major flat surface of the magazine itself. A very small minority of magazines, however, discharge their cartridges at an angle perpendicular, i.e., 90° to the major plane of the magazine. This is, of course, the case with most horizontal magazines. By "horizontal" the term is used to mean that the magazine lies in a plane parallel to that of the barrel. Since the use of horizontal magazines is relatively unique, the prior art related thereto is relatively limited The following prior art magazine devices may be of possible relevance. U.S. Pat. No. 2,630,645 describes an abutment at the end of the magazine slide which holds laterally oriented cartridges in place. An expanding spring causes the abutment to cover the exit opening thereby preventing bullets from exiting the magazine.

U.S. Pat. No. 2,773,325 discloses a magazine wherein abutting shoulders limit the extent of insertion of the cartridge container.

U.S. Pat. No. 2,882,635 describes a cartridge container having an end cap which retains the cartridges within the container only until the container is loaded into a firearm and, thereafter, the cartridges are free to move to a transfer mechanism.

U.S. Pat. No. 2,448,081 describes another magazine which positions its cartridges laterally relative to the direction of fire and relies on an elevator to raise them to a transfer member which orients them with respect to the firing mechanism. Apparently, gravity retains them in the magazine well.

Finally, U.S. Pat. No. 4,286,499 describes a feed mechanism including a feed lip, and a bias spring, and a curved guide surface for guiding the cartridges downward to a transferring mechanism.

It is dear from a review of the patent prior art that mechanisms for keeping cartridges from falling out of horizontal magazines are an area of very limited development.

Similarly, devices which employ rotating transfer disks to deliver cartridges from a horizontal magazine to the barrel of an automatic or semi-automatic weapon are relatively limited in number. The following U.S. patents are believed to be typical of the state of the art.

U.S. Pat. No. 2,624,241 describes a transfer disk, including an arcuate slot which mates with a pin in the firearm's chamber to control rotation of a transfer disk.

U.S. Pat. No. 4,004,363 describes an arresting means for a rotatable cartridge chamber which also helps to limit travel. In that embodiment, a pin drops into a special detent to prevent further rotation.

U.S. Pat. No. 3,997,994 assigned to Heckler & Koch is of general interest in that it describes a swivel breech which is designed to accommodate variations in gas forces used to power the breech's swivel action so that the breech is limited to approximately 90° of arcuate rotation without the need for a locking means as such. For similar mechanisms, also note the following U.S. Patents assigned to Heckler & Koch: U.S. Pat. Nos. 4,152,857 and 4,348,941.

Lastly, U.S. Pat. No. 5,610,362 is of general interest in that it discloses another mechanism for controlling the rotation of a rotatable cartridge transfer disk.

The improvements described in this disclosure relate primarily to mechanisms developed by the present inventors and described in U.S. Pat. No. 4,524,672 issued on Jun. 25, 1985 entitled "MAGAZINE AND FEED MECHANISM FOR FIREARMS" by Walter S. Balsavage, Jr. and U.S. Pat. No. 4,825,743 issued on May 2, 1989 entitled "MAGAZINE AND FEED MECHANISM FOR FIREARMS" naming Walter S. Balsavage and Floyd O. Aikman as co-inventors and assigned to Walter S. Balsavage, Jr., Trenton, N.J. The present invention is intended to improve over the specific mechanisms described in U.S. Pat. Nos. 4,524,672 and 4,825,743. While both devices perform well, two problems were noted. First, cartridges delivered from the horizontal magazine would sometimes fall out of the magazine or were not properly presented to the rotatable transfer disk by the insertion mechanism. Second, and synergistically, the rotatable transfer disk might occasionally travel beyond 90° thereby misaligning the cartridge with the feed mechanism and causing a jam. This is more likely to happen with high-powered ammunition in which the momentum created by the recoil of the firearm was such that the transfer disk was overdriven beyond the 90° alignment point. It has been found that by improving the magazine as described in this disclosure and improving the rotatable transfer disk so that it does not travel beyond 90°, synergistically enhances the performance and dependability of the firearm. Insofar as understood, none of the prior art references cited herein, or known to the inventors, hint, teach or disclose the inventive concept set forth herein.

SUMMARY OF THE INVENTION

Briefly described, the invention comprises an improvement to horizontal magazines employed on small firearms and the rotatable cartridge transfer disks used in conjunction therewith. The improved magazine preferably includes an end cap and/or a related leaf spring mechanism to keep the cartridge at the loading end of the magazine in proper alignment prior to insertion into the rotatable transfer disk. The magazine end cap may also be used in conjunction with a spring-loaded flap and/or a cartridge guide mechanism to further enhance the accuracy of the alignment of the cartridge with respect to the rotatable cartridge transfer disk after ejection from the magazine by the injector mechanism.

The rotatable cartridge transfer disk is typically driven by the slide and rail mechanism either during cocking or by the recoil of the firearm after firing. According to a first embodiment, pins on the transfer disk interact with projections and indentations in one of the slide rails to rotate the transfer disk and then hold it in position after the disk has rotated 90°. According to a second embodiment of the rotatable transfer disk mechanism, tabs or irregularly spaced teeth on the periphery of the rotatable transfer disk interact with apertures and surfaces on one of the rails to rotate the mechanism 90°. After the mechanism has rotated 90° there is sufficient slack or space in the last tooth engaged aperture to prevent the transfer disk from traveling beyond 90°.

According to a third embodiment, the transfer disk has regularly spaced teeth which engage with regularly spaced teeth on the rail, like a rack, but includes an arresting mechanism for preventing the transfer disk from substantially traveling beyond 90° once it reaches that point.

According to a fourth embodiment of a rotatable transfer disk, the regularly spaced teeth on the transfer disk interact with regularly spaced pins on a guide rod which includes a spring loaded stop to gently bring the rotatable transfer disk to rest at the 90° rotation point without over travel.

These and other features of the invention will be more fully understood by reference to the following drawings.

DETAILED DESCRIPTION OF THE INVENTION

During the course of the description, like numbers will be used to identify like elements according to the different figures that illustrate the invention.

Figure 1A:
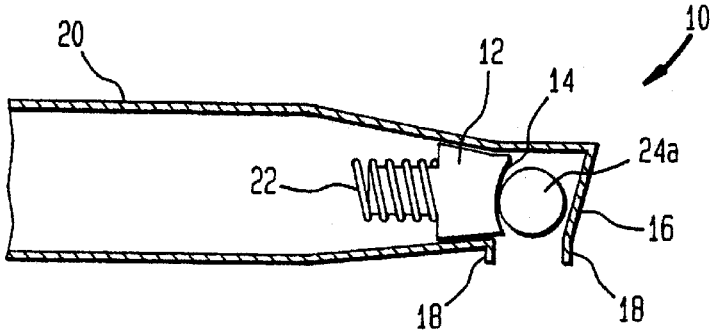
FIGS. 1A–1J illustrate various different views of the improved horizontal magazine including an end cap for holding the cartridge in place prior to insertion according to the preferred embodiment of the invention.
Figure 1B:
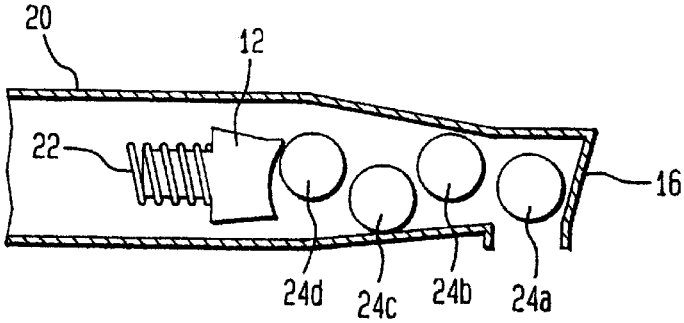
Figure 1C:
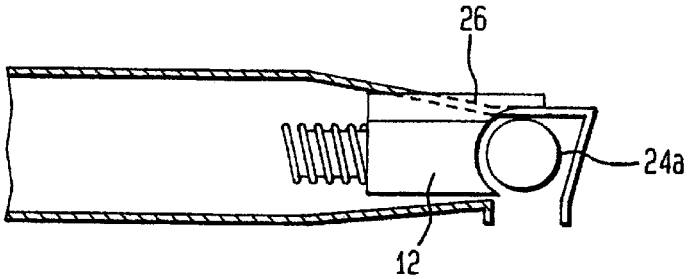
Figure 1D:
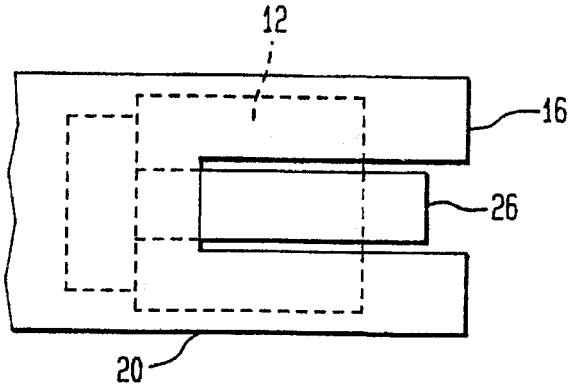
Figure 1E:
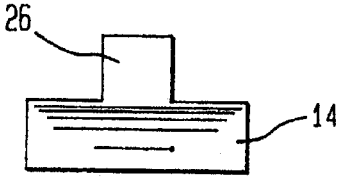

The purpose of the improved magazine 10 is to prevent cartridges from inadvertently coming out of the magazine 20. FIGS. 1A–1C show that the follower 12 has a curved face 14 which is angled to interact with cartridges 24A–24D. The magazine 12 includes an end plate or face 16 that curves beyond 90° and holds the cartridge 24A in position against the pressure of the follower 12. Endplate 16 includes a pair of lips 28, which are spaced slightly wider than the diameter of the cartridge 24. Follower 12 is biased towards the front face 16 of the magazine 20 by spring 22. The views of FIGS. 1C, 1D and 1E illustrate a top rib 26 on the follower 12 which fits into a slot at the front of the magazine 12 and which serves as a guide for the follower and protrudes out the front part of the magazine, as shown in FIG. 1D, allowing the user to push it back thereby making the loading of the magazine 10 easier.

Figure 1F:
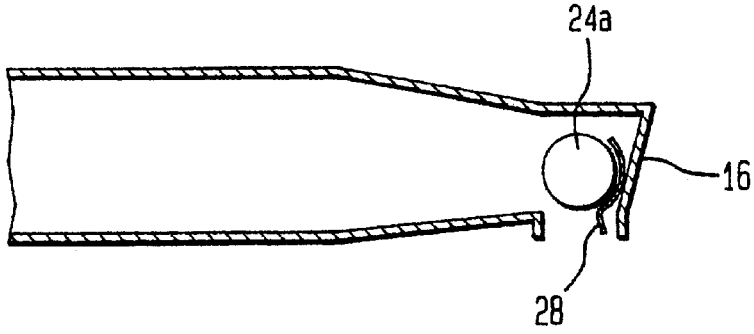

FIG. 1F illustrates the use of a leaf spring 28 which, when combined with the follower 12, holds the cartridges 24A–24D in the magazine 10.

Figure 1G:
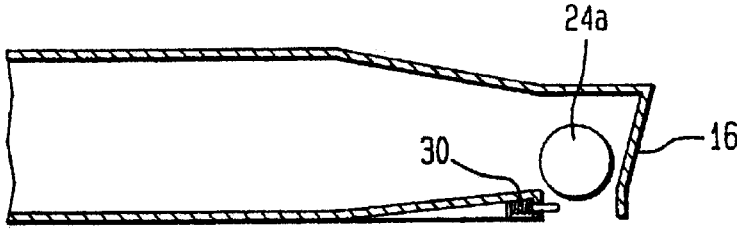
Figure 1H:
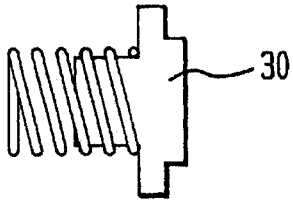
Figure 1I:
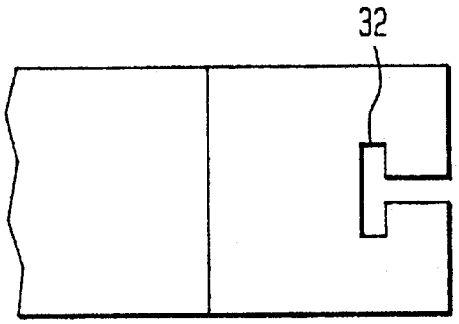
Figure 1J:
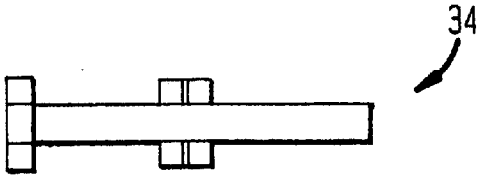

The views of FIGS. 1G and 1H and 11 illustrate a spring biased protrusion mechanism 30 that also serves to hold cartridges 24A–24D in position until forced out of the opening by the injector head 52. Instead of having a large slot in front of the magazine as illustrated in FIG. 1D, a smaller T-shaped slot 32, illustrated in FIG. 11, into which a correspondingly T-shaped injector 34, illustrated in FIG. 1J, is received. This prevents the magazine 20 from accepting more debris than necessary.

Figure 2A:
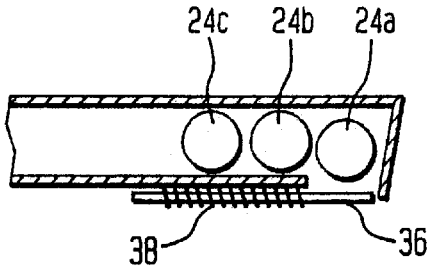
FIGS. 2A–2C illustrate different views of another horizontal magazine embodiment including a spring loaded bottom flap for additional protection against accidental loss of cartridge.
Figure 2B:
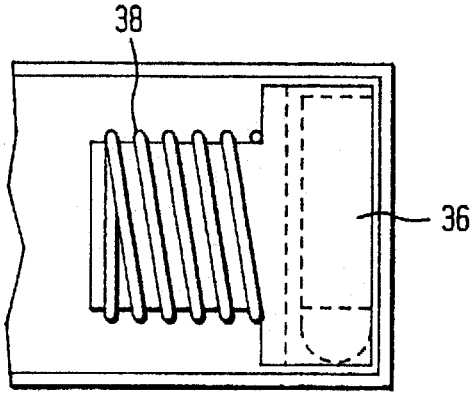
Figure 2C:
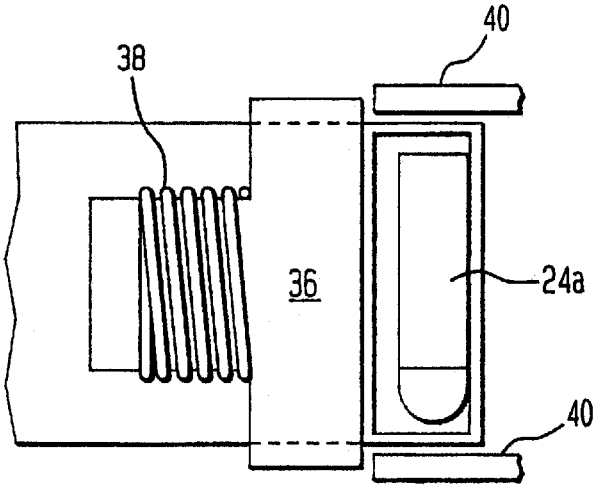

There are also other mechanisms for preventing cartridges from inadvertently coming out of a horizontal magazine such as described herein. FIGS. 2A–2C illustrate the use of a movable flap 36 which is biased by a spring 38 to close off the cartridge outlet aperture when the magazine is not in use. When the magazine is placed into position on the firearm, projections 40 force the flap 36 backwards against the bias spring 38, thereby permitting the injector 12 to force cartridge 24A into the rotatable transfer disc as will be described in detail later on.

Figure 2D:
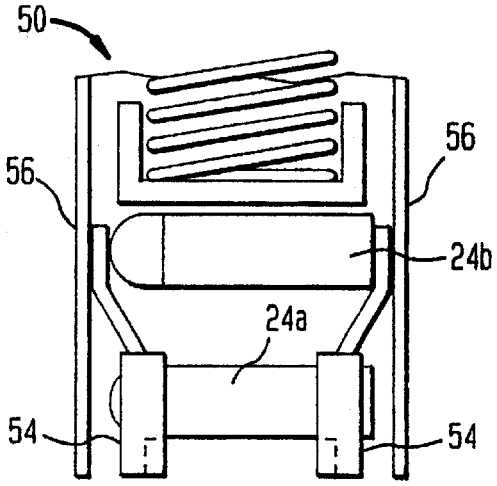
FIGS. 2D–2F illustrate another horizontal magazine embodiment in which a built in cartridge holder and guide assists in the correct orientation and alignment of the cartridge at the dispersal end of the magazine prior to injection.
Figure 2E:
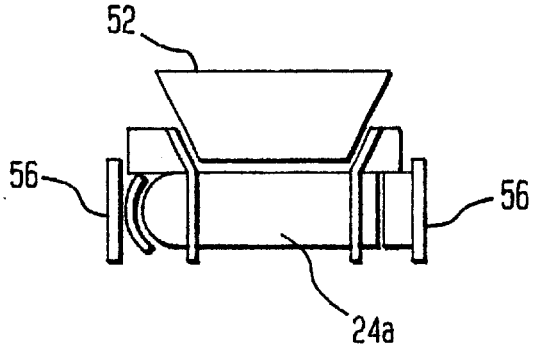
Figure 2F:
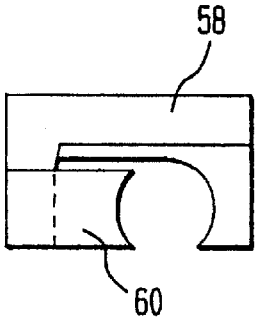

FIGS. 2D, 2E and 2F illustrate a cartridge holder/guide mechanism for centering cartridges of different lengths and holding the cartridges in position until pushed out by the head 52 of the cartridge injector 12. The cartridge 24A according to embodiment 50 is located between sidewalls 56. Guides 54, 58 and 60 guide the cartridge 24A into proper centered alignment so that it is neatly received in the aperture in the rotatable transfer disc after it is ejected by the injector head 52.

Figure 3A:
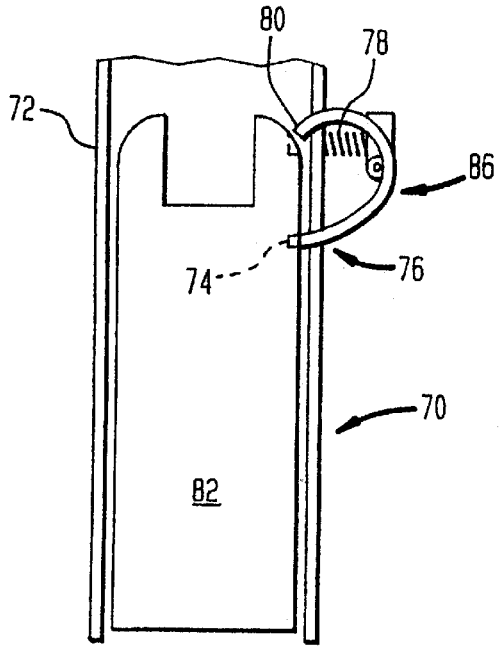
FIGS. 3A–3D illustrate different views of possible magazine latch and ejector mechanisms appropriate for use with the improved horizontal magazine structure.
Figure 3B:
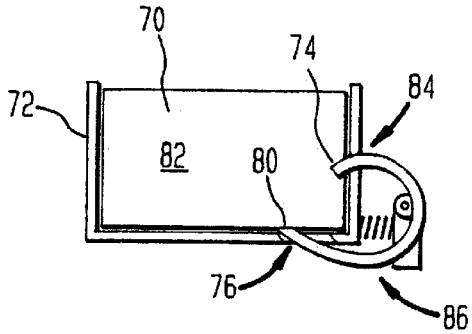

FIGS. 3A and 3B illustrate a frame 70 that includes a magazine latch and ejector mechanism 86. The magazine 82 is located between the two slide sides 72. This particular latch and ejector mechanism can be used with both vertical and horizontal magazines. Magazine 82 is held in the frame 72 by the tip 74 of the magazine latch pin which protrudes through an aperture 76 in the frame 72. The opposite end 80 of the latch 86 also protrudes through an aperture in the frame 72 and impinges upon the magazine 82 to keep it in position. A spring 78 biases the latch 86 into its normally locked condition. When the magazine latch 86 is depressed, it pivots around the pivot point thereby withdrawing the tip 74 and unlatching the magazine 82. The distal, or other, tip 80 simultaneously pushes the magazine 82 out of or off of the firearm. FIG. 3B illustrates a similar structure for a horizontal magazine 82. The magazine 82 can be located anywhere around the axis of the barrel or stock. The magazine 82 is held in place by the tip 74 of the magazine latch 86 in the matter previously described. Tip 74 passes through an aperture 80 in the frame 72. The other end 80 of the latch 86 passes through a second aperture 76 and touches the bottom portion of the magazine 82. Pushing on the latch 86, withdraws the tip 74 from aperture 84 and simultaneously forces the tip 80 against the bottom side of the magazine 82 forcing it out of the frame 72.

Figure 3C:
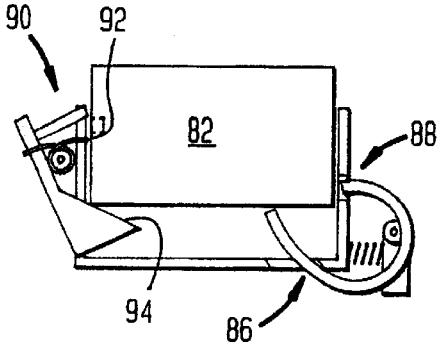

FIG. 3C illustrates an additional ejector mechanism 90 comprising a spring having a tip 92 and mounted on bracket piece 94. Ejector mechanism 90 is an alternative method for popping magazine 82 out of the frame. Pulling the bracket 94 away from the magazine 82 releases part 92 and simultaneously pushes up with the foot of the frame 94 forcing the magazine 82 out of the frame 72.

Figure 3D:
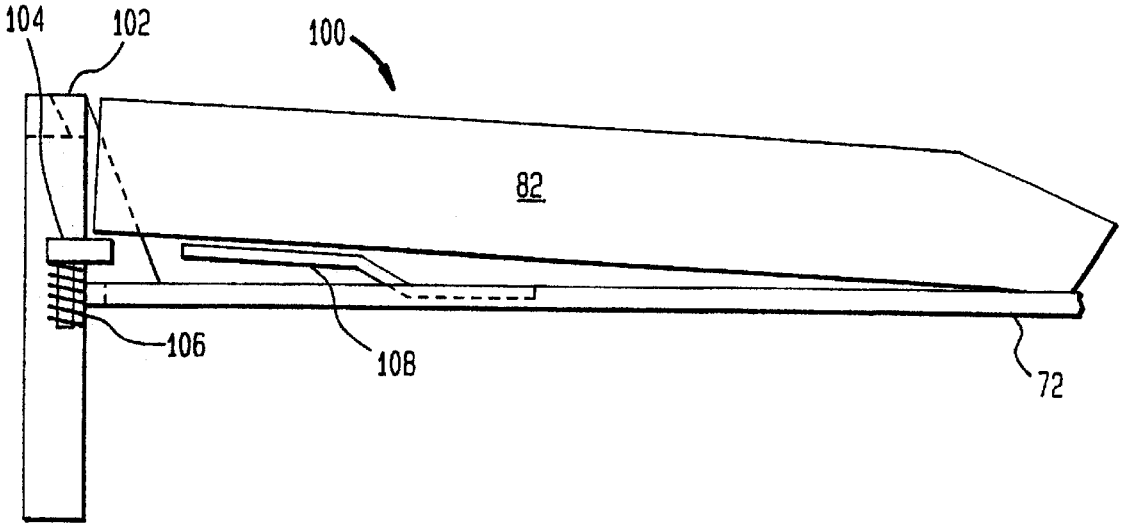

FIG. 3D illustrates a magazine ejector 100 attached to the front sight mount 102 and including the magazine ejector element 104 biased by coil spring 106. Ejector leaf spring 108 is located between the frame 72 and the broad under face portion of the magazine 82. The releasing of the ejector 104 permits the leaf spring 108 to force the magazine 82 out of the frame 72.

Figure 4A:
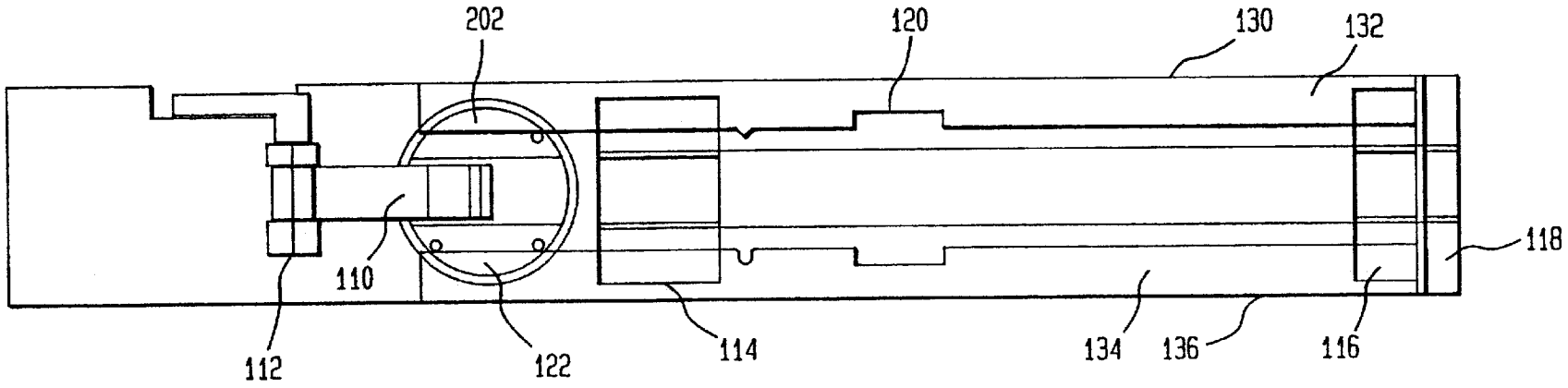
FIGS. 4A and 4B illustrate top plan and right side elevational views, respectively, of the slide, rail, rotatable cartridge transfer disk and cartridge injector assemblies.
Figure 4B:
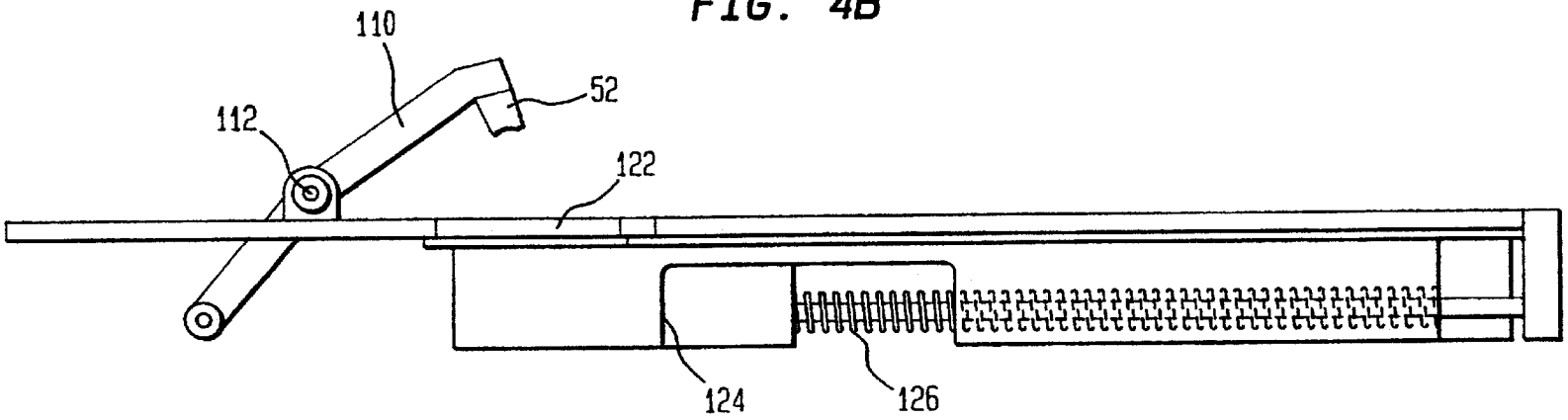
Figures 5A, 5B, 5C, 5D, 5E, 5F:
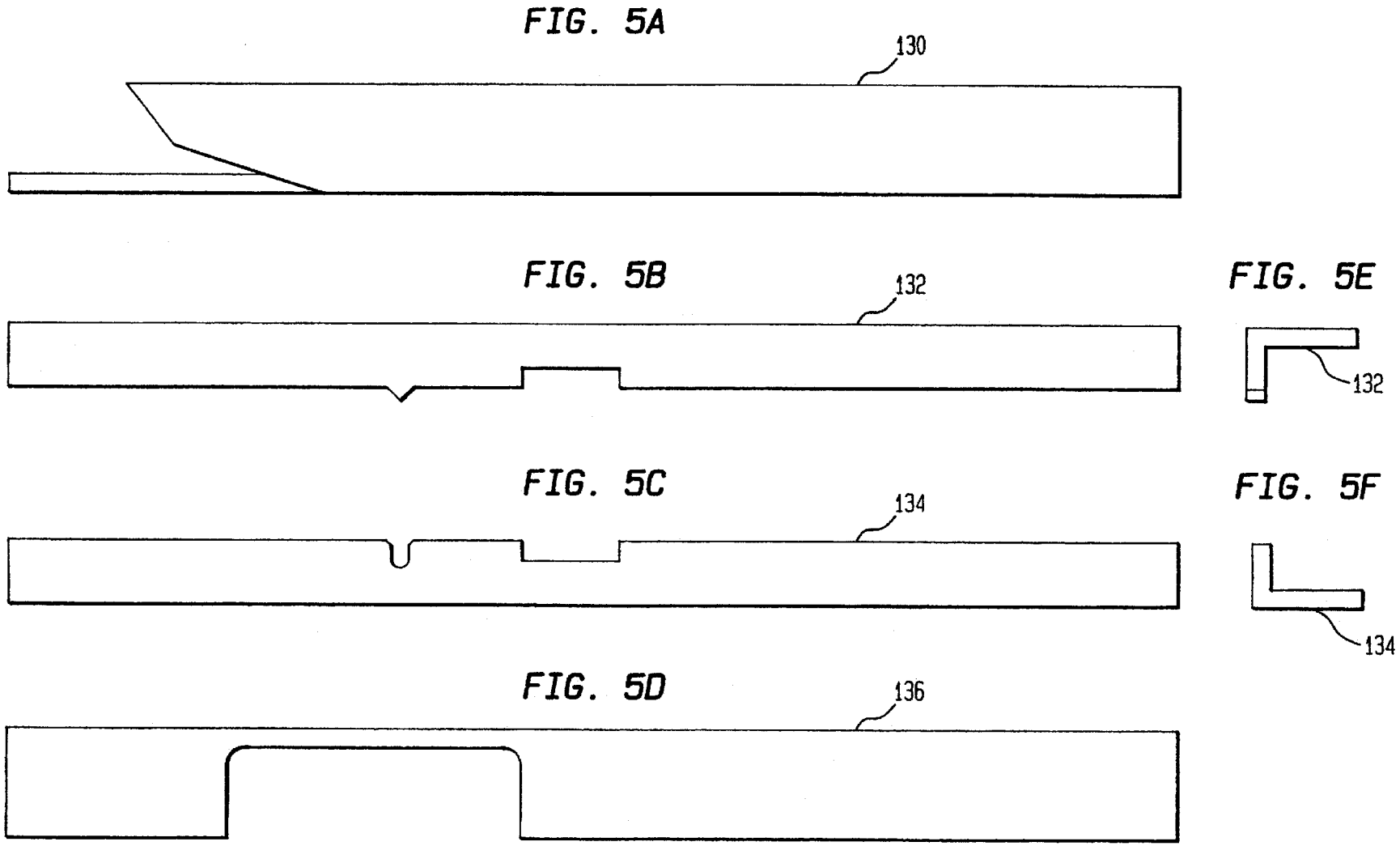
FIGS. 5A–5F illustrate the left slide, the left rail, the right rail, the right slide, an end view of the left rail, and an end view of the right rail, respectively.

FIGS. 4A and 4B respectively disclose how the rails interface with the pins to rotate the feed disk from the load to the chambered positions. FIG. 4B illustrates the injector lever 110 attached to a pivot point 112 including the ejector face 52. See also the elements in FIGS. 11A–11D. The right side slide 130 supports the right side rail 132 and is held in position by the front support 118 and the bolt guide 116. The right side slide 136 and rail 134 are likewise connected by the bolt guide 116 and the front support 118. The right and left slides 130, 136 respectively include a feed window 120. Breech block 114 provides further support to the slides 130 and 136. The rotatable feed disc 202 is located aft of the breech block 114 and is driven in the manner described in FIGS. 6A–9B.

Figures 6A, 6B, 6C:
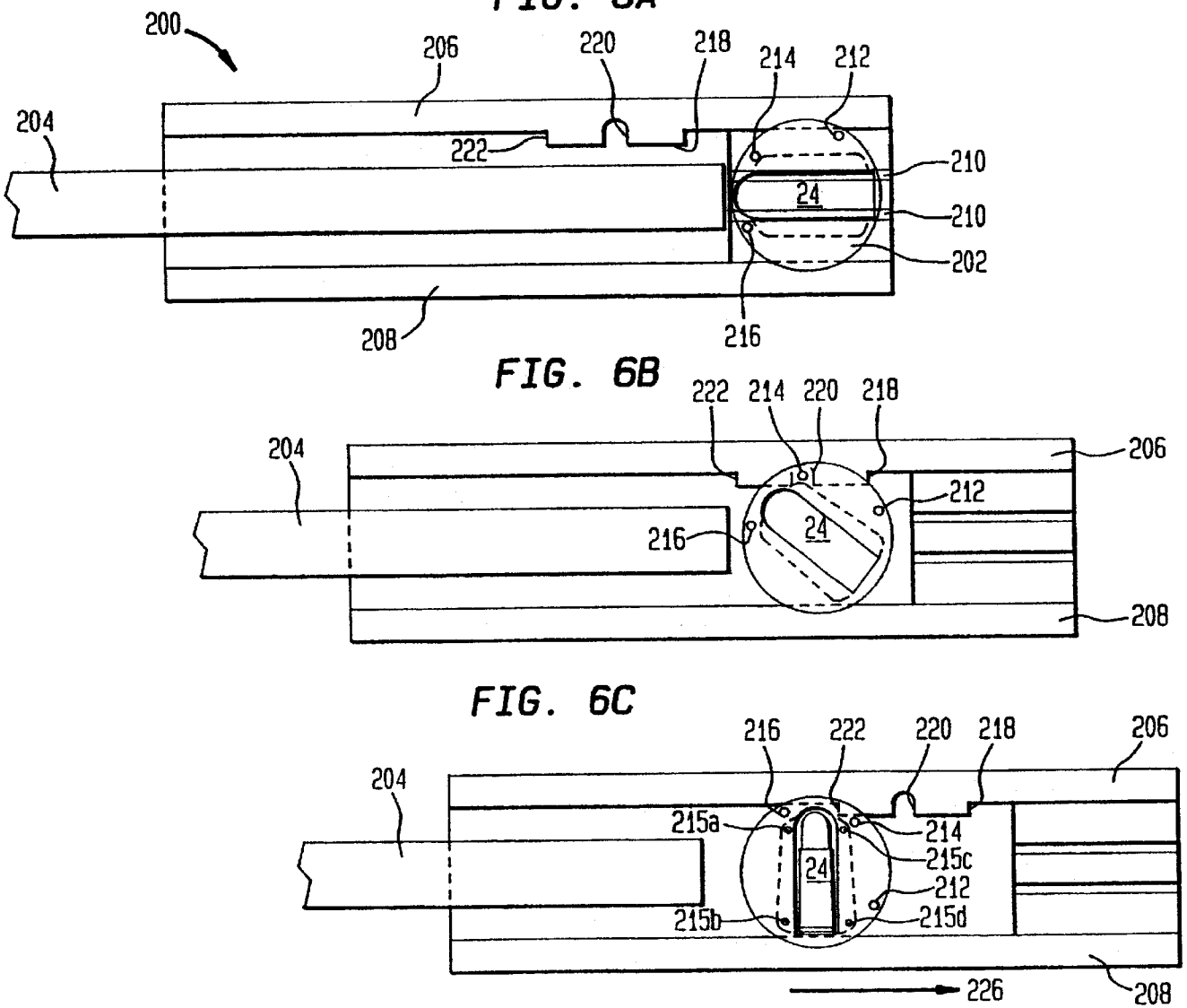
FIG. 6A illustrates the preferred embodiment of the rotatable transfer disk mechanism in which the disk includes three pins which engage with indentations or projections on the slide mechanism and in which the rotatable transfer disk is shown prior to recoil or cocking according to the preferred embodiment of the invention.
FIG. 6B illustrates the embodiment of FIG. 6A in which the transfer disk has started to rotate under the influence of the recoiling slide.
FIG. 6C illustrates the rotatable transfer disks of FIGS. 6A and 6B in which the disk and cartridge have rotated 90° and are held in that position by the structure of the slide rail and transfer disk.

The preferred embodiment 200 of the transferred disc drive mechanism is illustrated in progressive detail in FIGS. 6A and 6C. Rotatable transfer disc 202 is located between the upper rail timing bar 206 and the lower rail 208. Barrel 204 is shown in alignment with cartridge 24. A pair of slots 210 are located aft of the transfer disc 202 for accepting the feed lips. Rotatable transfer disc 202 includes three (3) drive pins 212, 214 and 216 respectively. Pins 212, 214 and 216 engage respectively with projection 218, indent 220 and projection 222 of the upper rail/timing bar 206. FIG. 6A illustrates the preferred embodiment 200 prior to cocking or recoil.

FIG. 6B illustrates the preferred embodiment 200 after recoil or cocking has begun and the rotatable transfer disk 202 has started to revolve about 30°. Projecting surface 218 has just contacted the first pin 212 on disk 202 causing it to rotate and bring the second pin 214 into indentation 220. Continued backward motion of the slide away from the barrel 204 causes the transfer disk 202 to continue to rotate until it is in the full 90° position as illustrated in FIG. 6C. Further rotation of the transfer disk 202 beyond the 90° point as shown in FIG. 6C is impossible because the ends of the feed lips 215*a*, 215*b*, 215*c*, and 215*d* and pins 214 and 216 hold the disk in the 90° position between the two rails 206 and 208. Therefore, the cartridge 24 is always properly presented from the magazine to the transfer disk 202 regardless of the amount of recoil that may have been occasioned by high power ammunition.

Figure 7A:
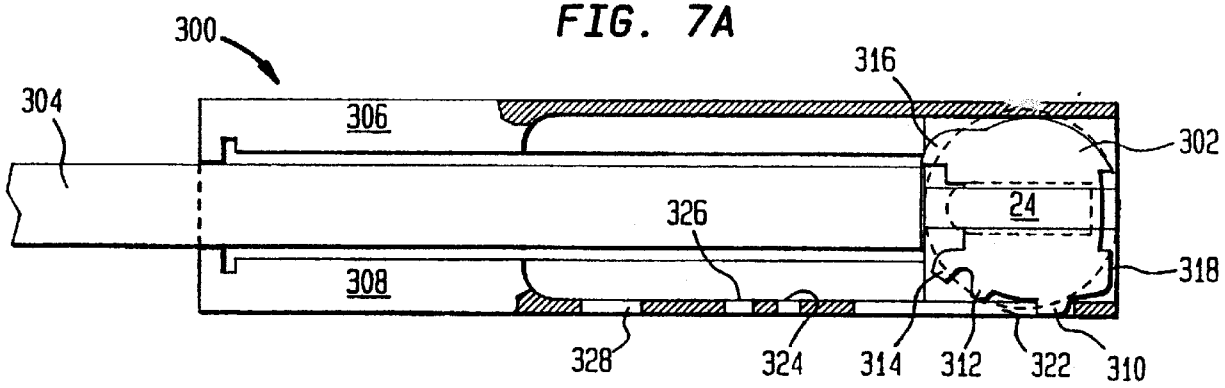
FIG. 7A illustrates an alternative embodiment of the rotatable transfer disk invention in which the transfer disk includes irregularly spaced teeth or projections which engage with irregularly spaced apertures and projections on the left slide and in which the rotatable transfer disk is shown in its cocked position.
Figure 7B:
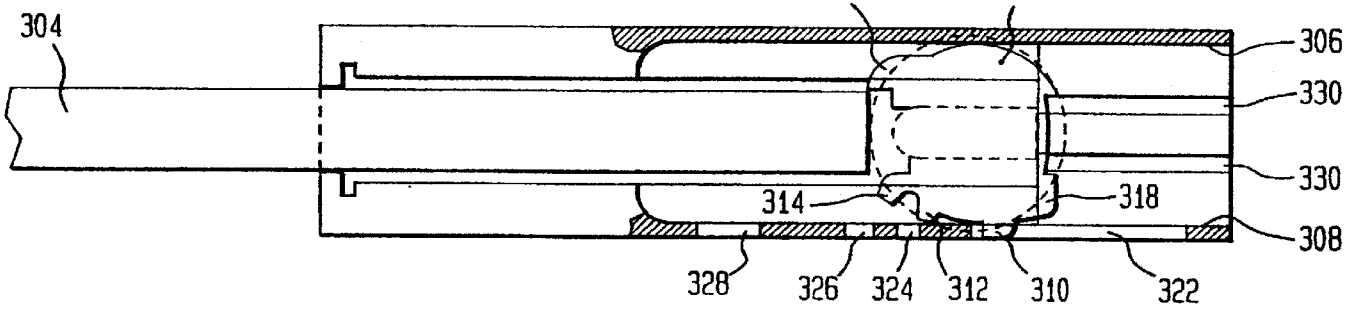
FIG. 7B illustrates the rotatable transfer disk according to FIG. 7A partway through the recoil or cocking motion.
Figure 7C:
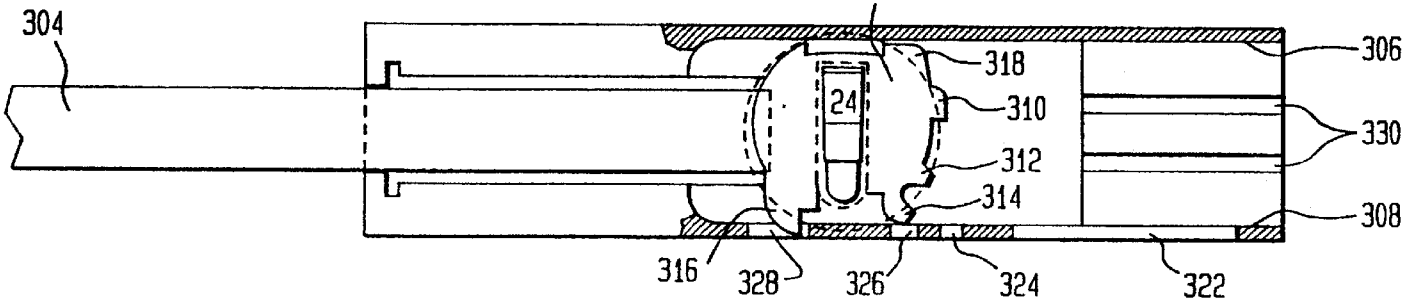
FIG. 7C illustrates the rotatable transfer disk of FIGS. 7A and 7B in which the rotatable transfer disk has rotated 90° and is held in that position by the structure of the rotatable transfer disk and the drive rail.
Figure 7D:
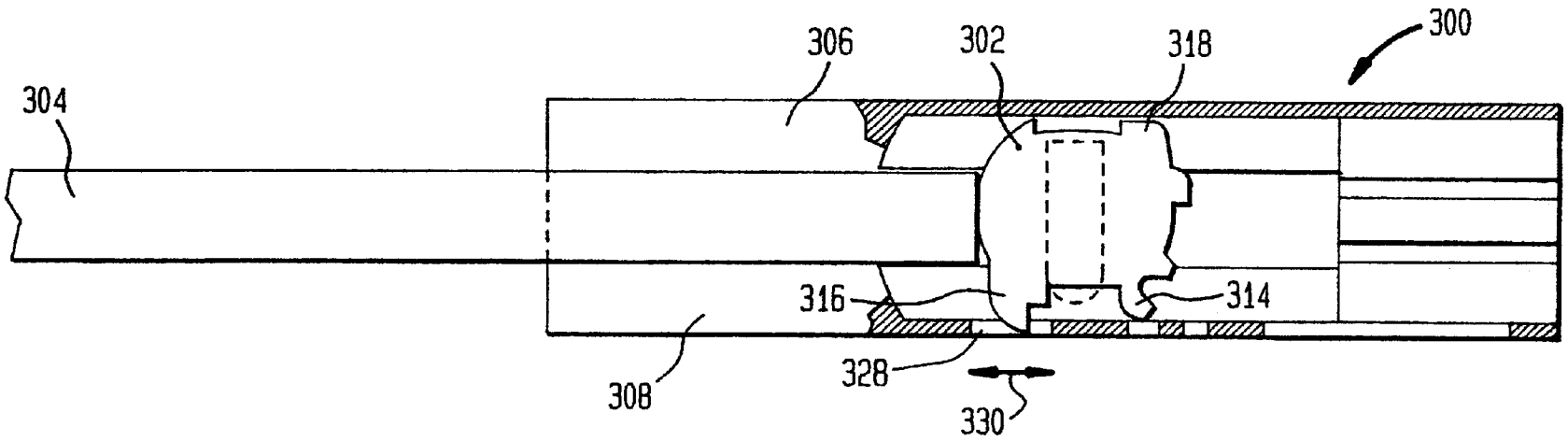
FIG. 7D illustrates in further detail the additional play in the left rail aperture that permits the rotatable transfer disk to rotate 90° but no further.

A second alternative embodiment 300 is illustrated in FIGS. 7A–7C. The rotatable transfer disk 302 is aligned in FIG. 7A with the bore of the barrel 304 and is positioned between upper rail 306 and lower rail 308. Rotatable transfer disk 302 includes four irregularly shaped and spaced teeth 310, 312, 314 and 316, respectively. Teeth 310–316 are respectively received in apertures 322, 324, 326 and 328, respectively. FIG. 7A illustrates the transfer disk 302 in parallel alignment with the barrel 304 immediately prior to cocking or recoil. Recoil causes the slide mechanism 306 and 308 to move backwards as illustrated in FIG. 7B. Note also the slots for the feed lips 330. Tooth 310 moves along aperture 322 until it impinges upon the projection which causes the transfer disk 302 to rotate. Thereafter, tooth 312 engages rail aperture 324, 314 engages rail aperture 326, and finally, tooth 316 engages rail aperture 328 so that the transfer disk ultimately arrives at the full 90° position as shown in FIG. 7C. If the slide mechanism continues to move backwards, as illustrated in FIG. 7D, the transfer disk 302, nevertheless, remains in the 90° position held between the rails 306 and 308 by the contact of tooth 318 with rail 306 and the contact of tooth 314 with rail 308. In addition, very importantly, aperture 328 in rail 308 is significantly wider than transfer disk tooth 316 so that there is a substantial amount of play illustrated by arrow 330. This permits the slide mechanism to continue to move backward without forcing the transfer disk 302 beyond the 90° position.

Figure 7E:
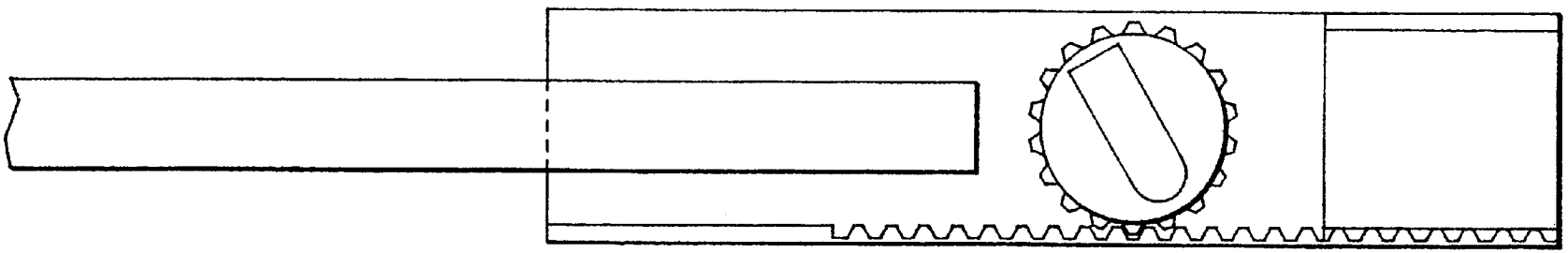
FIG. 7E illustrates a prior art rotatable transfer disk in which evenly spaced teeth on the transfer disk ride on a rack on the rail and in which the cartridge has traveled well past 90° thereby making injection into the breech difficult, if not possible, thereby leading to jamming or other dangerous malfunction conditions.

In contrast, note FIG. 7E and embodiment 400 which illustrates a generic prior art rotatable transfer disk in which the transfer disk includes a plurality of regularly spaced teeth which mate with regularly spaced teeth on the slide rail. In this worse case embodiment, the slide is shown to be fully driven backwards, perhaps by a very high powered charge, causing the transfer disk to move beyond the 90° position perhaps as much as 100° or 110°. This, in turn, creates a mismatch by 10–20° between the magazine and the transfer disk thereby causing jamming or other malfunctions. The embodiments 200 and 300 just described are not susceptible to travelling beyond 90° because of the mechanisms provided prevent such overtravel.

Figure 8C:
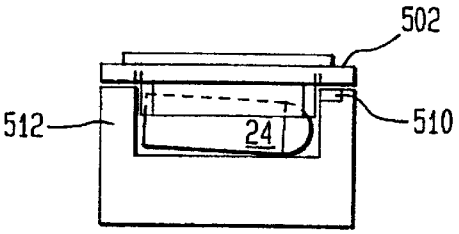
FIG. 8C illustrates in better partial cross sectional detail the mechanism for preventing the rotatable transfer disk from travelling beyond 90° and how the cartridge is held safely inside of the slide in case of accidental firing.
Figure 8A:
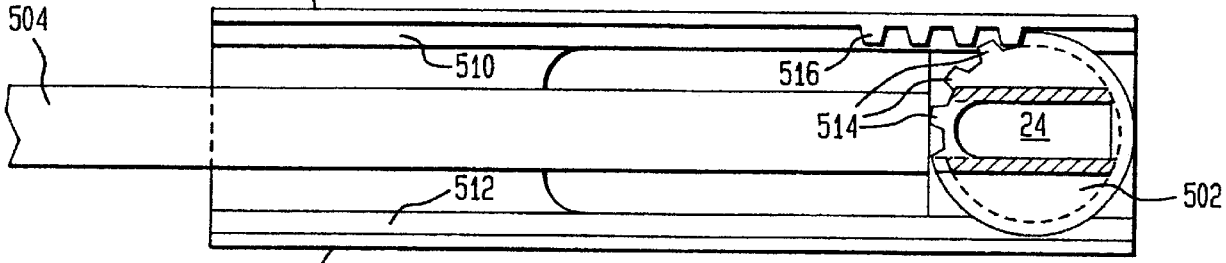
FIG. 8A illustrates another alternative embodiment of the rotatable transfer disk in which the rotatable transfer disk includes evenly spaced teeth which engage with, and are driven by, evenly spaced teeth on a rack on the right side rail, all of which are seen prior to recoil.
Figure 8B:
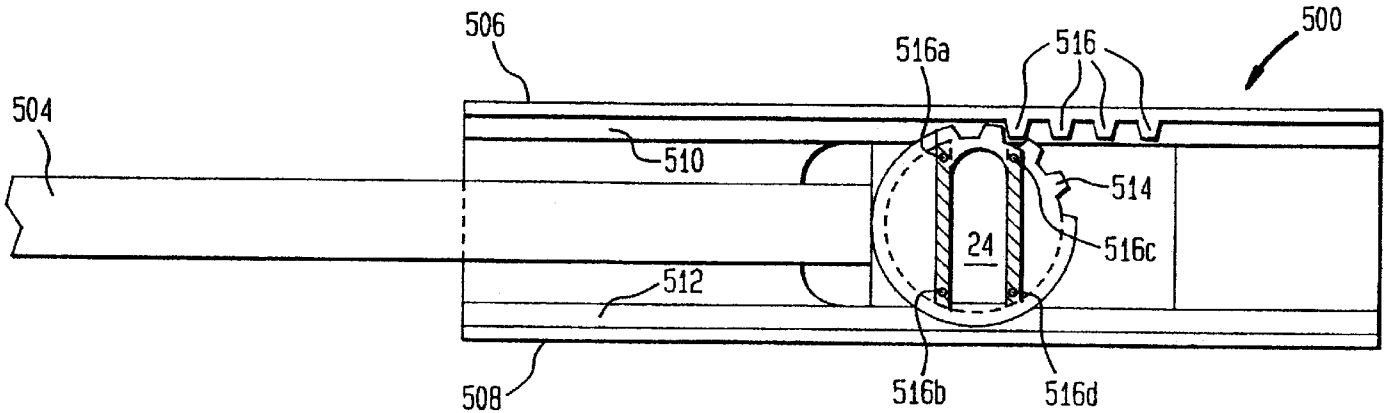
FIG. 8B illustrates the same rotatable transfer disk after full cocking or recoil has taken place with the cartridge shown in its 90° position and held there by the structure of the transfer disk and rail.

Embodiment 500 illustrated in FIGS. 8A–8C discloses another approach to prevent overtravel of a rotatable cartridge transfer disk 502. Transfer disk 502 is shown in alignment with barrel 504 in FIG. 8A. Upper rail 506 includes a plurality of regularly spaced teeth 516 in a rack-like formation. Rib 510 is attached to rail 506. Lower rail 508 similarly has a second rib 512 attached thereto. Regularly spaced teeth 514 are located on the periphery of rotatable transfer disk 502 and mate with the valleys between the teeth 516 in rail 506. During recoil, the teeth 516 drive the disk teeth 514 into the 90° transfer position as illustrated in FIG. 8B. FIG. 8C is a cross-sectional view illustrating the cartridge in the 90° transfer position shown in FIG. 8B. When the slide recoils to the rear, the gear teeth 514 turn the feed disk 502 to the feed position where the cartridge injector (not shown in this view) would inject the cartridge into the feed disk 502. Since there are no gear teeth 516 after the last one on the rack, the slide is free to recoil to the rear without overdriving the rotatable transfer disk 502. In the mode illustrated in FIGS. 8B and 8C, the disk 502 is held in position by the feed lips 516*a*, 516*b*, 516*c* and 516*d*, which ride between the inner ribs or rails 510 and 512, respectively. While the gear teeth 514 are shown on the top surface of the transfer disk 502, they could also be placed on the bottom surface if desired also.

Figure 9A:
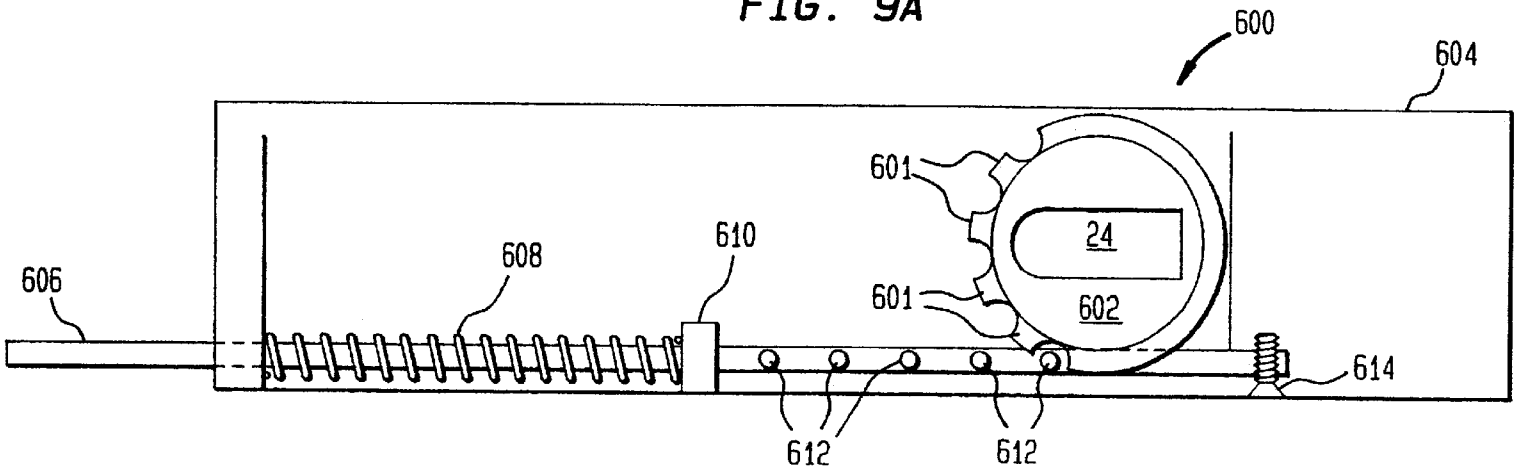
FIG. 9A is a top plan view which illustrates another embodiment for driving a rotatable transfer disk in which the rotatable transfer disk has a plurality of evenly spaced teeth which engage with pins on a guide rod which also guides the recoil spring and where the pins are located on the guide rod instead of on the slide as shown in FIGS. 8A–8C.
Figure 9B:
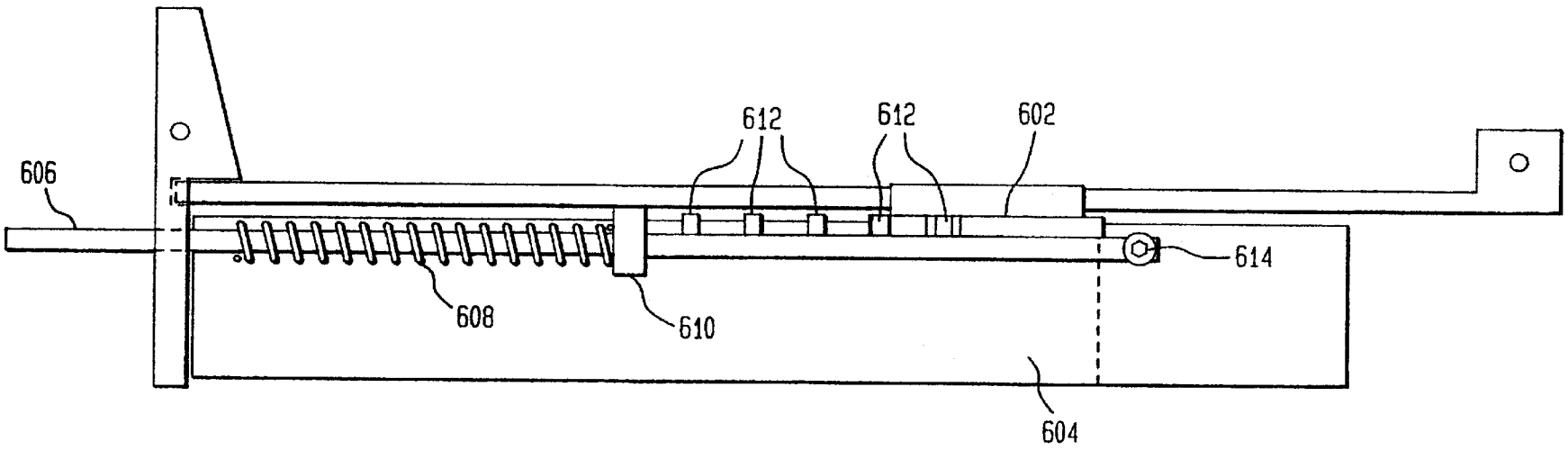
FIG. 9B is a side elevational view of the rotatable transfer disk mechanism illustrated in FIG. 9A.
Figure 10A:
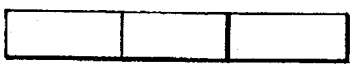
FIGS. 10A–10C illustrate orthogonal views of the front support.
Figure 10B:
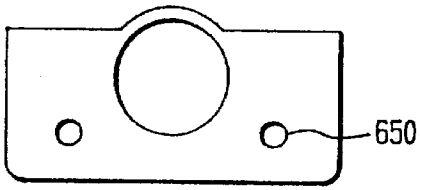
Figure 10G:
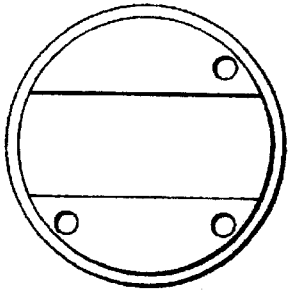
FIGS. 10G–10I illustrate different orthogonal views of the rotatable transfer feed disk.
Figure 10C:
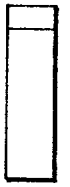
Figure 10D:
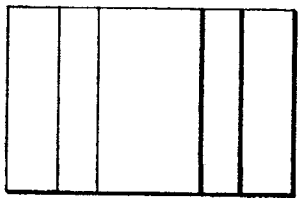
FIGS. 10D–10F illustrate orthogonal view of the breech block.
Figure 10I:
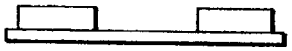
Figure 10J:
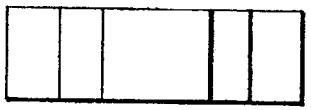
FIGS. 10J–10L illustrate different orthogonal views of the spring guide and related clearance.
Figure 10E:
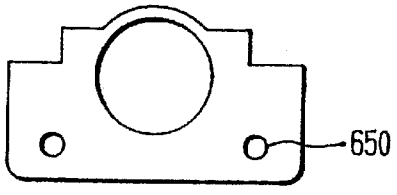
Figure 10K:
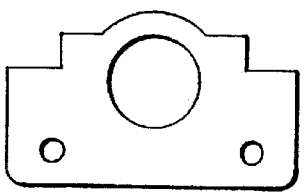
Figure 10F:
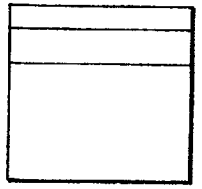
Figure 10L:
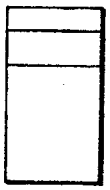
Figure 10H:
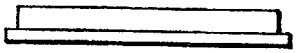
Figure 11D:
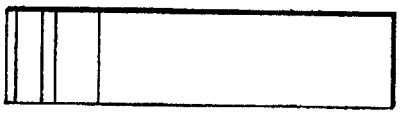
FIGS. 11C and 11D illustrate side and front views of the ejector link showing the injector head.
Figure 11C:
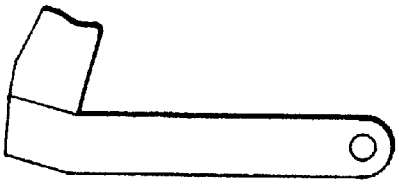
Figure 11B:
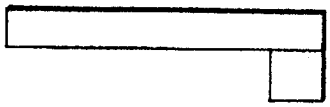
FIGS. 11A and 11B illustrate top and side views of the injector link driver.
Figure 11A:
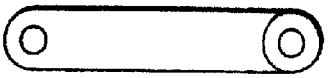
Figure 11H:
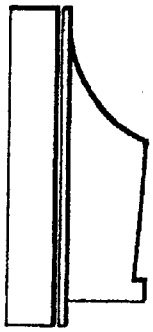
FIGS. 11G and 11H illustrate front and side views of the feed lips.
Figure 11G:
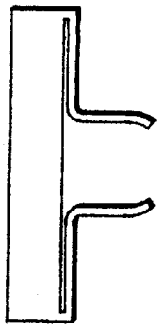
Figure 11F:
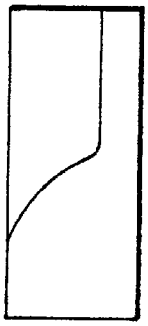
FIGS. 11E illustrates the front of the breech face and 11F illustrates a side view of the return cam mechanism for the cartridge injector.
Figure 11E:
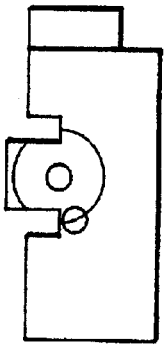
Figure 12D:
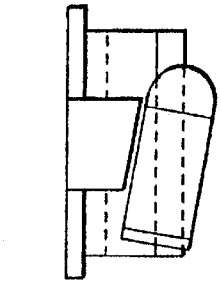
FIG. 12D is a partial cross-sectional view of the feed disk with a cartridge in position and held by a cartridge catch as it is being forced therein in the injector mechanism.
Figure 12A:
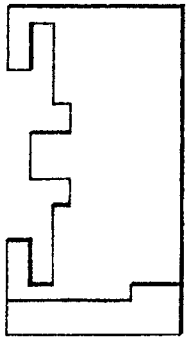
FIGS. 12A and 12B illustrate rear of slide and lower portion of the cartridge injector.
Figure 12B:
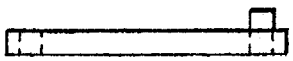
Figure 12C:
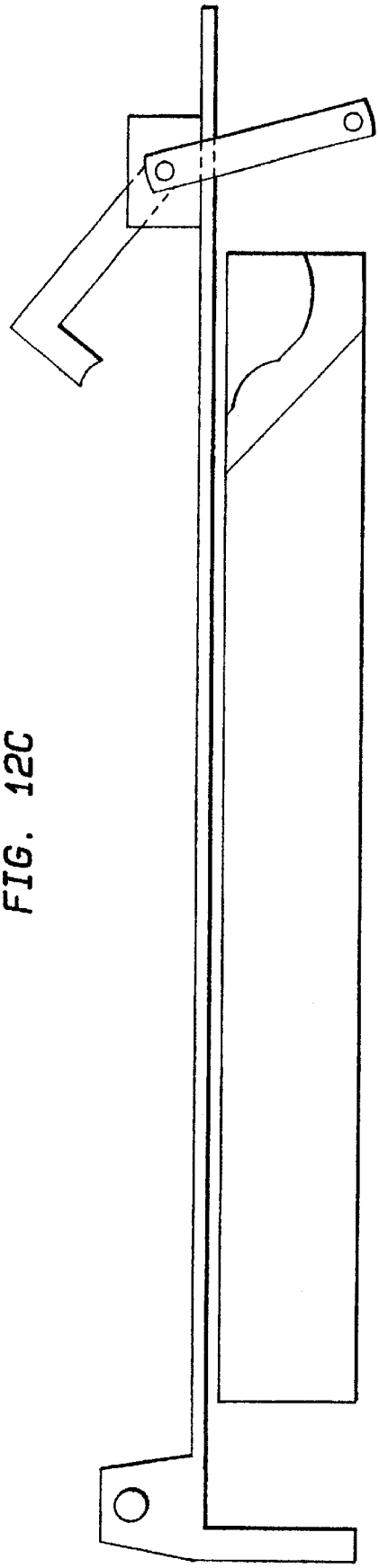
FIG. 12C is a side elevational view showing the cartridge injector in position above the slide mechanism.
Figure 13D:
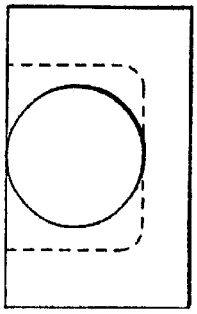
FIGS. 13A–13E illustrate top, side, bottom, front and rear views respectively of the slide and actuator elements.
Figure 13E:
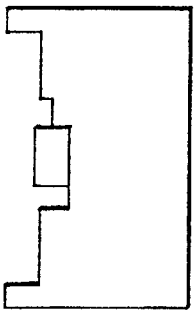
Figure 13A:
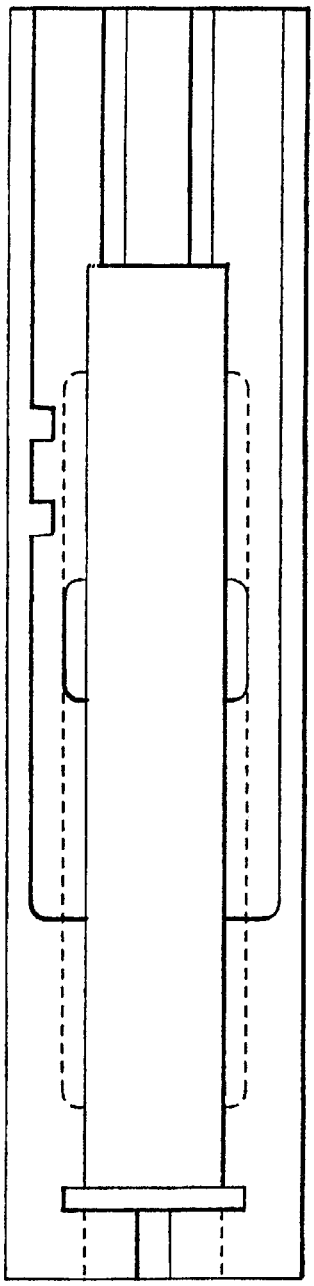
Figure 13B:
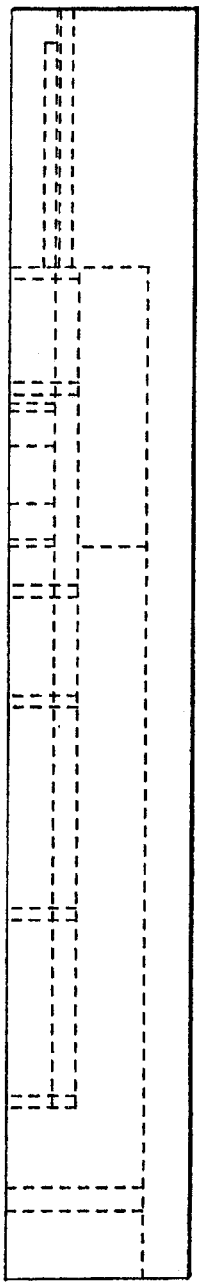
Figure 13C:
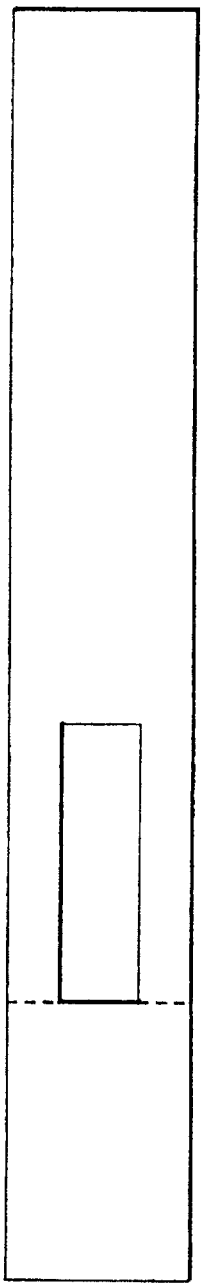
Figure 14A:
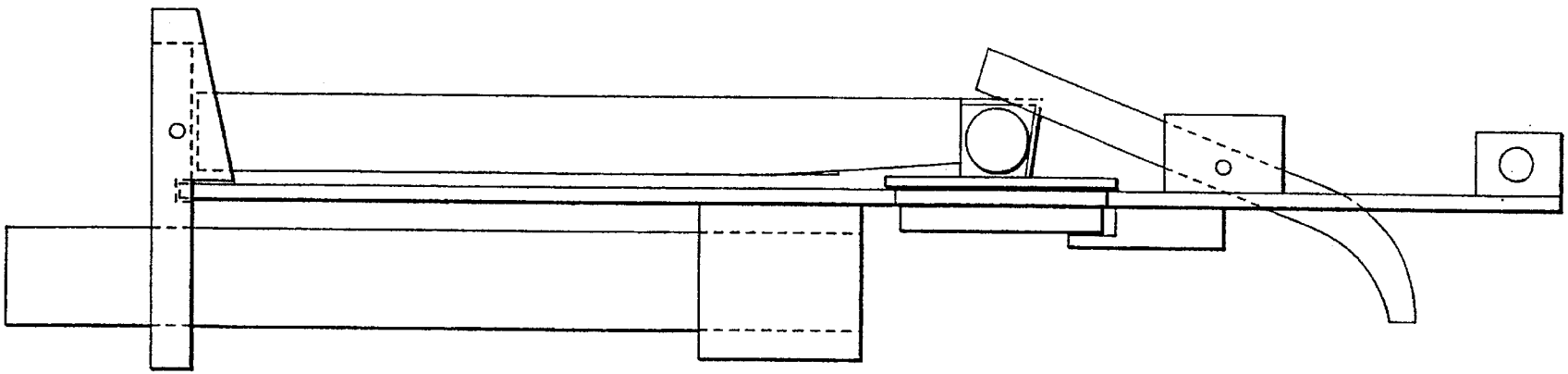
FIGS. 14A and 14B illustrate side and top views partially assembled receiver plate and related structures.
Figure 14B:
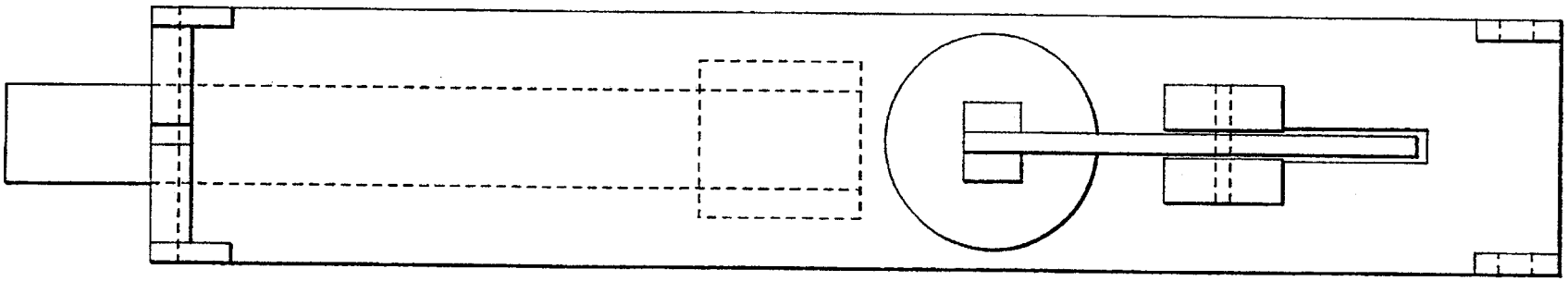
Figure 15B:
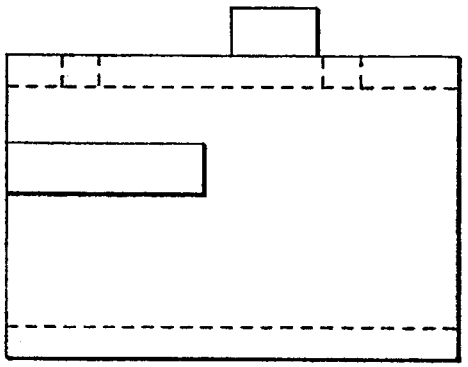
FIGS. 15A–15C illustrate orthogonal views of the barrel mount and its relationship to the slide mechanism.
Figure 15C:
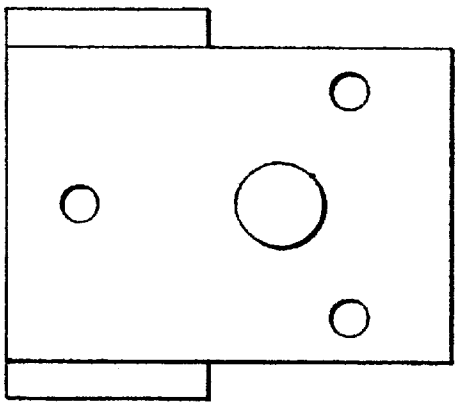
Figure 15A:
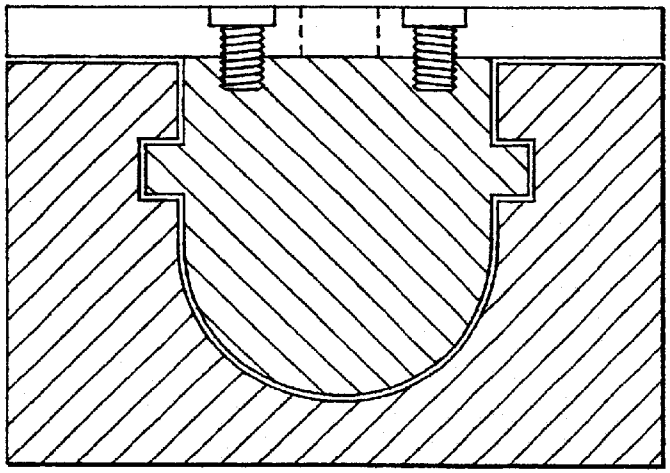
Figure 16A:
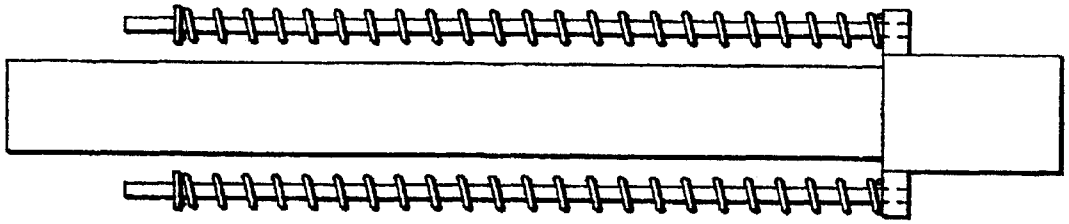
FIGS. 16A–16C illustrate various orthogonal views of the barrel mount, recoil springs and guides, receiver top, the barrel, and the slide.
Figure 16B:
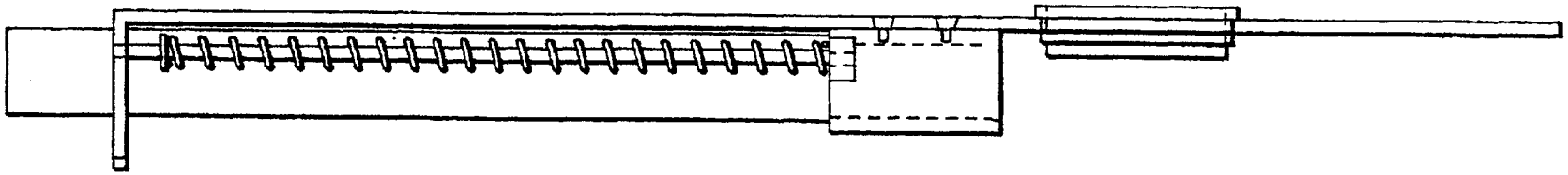
Figure 16C:
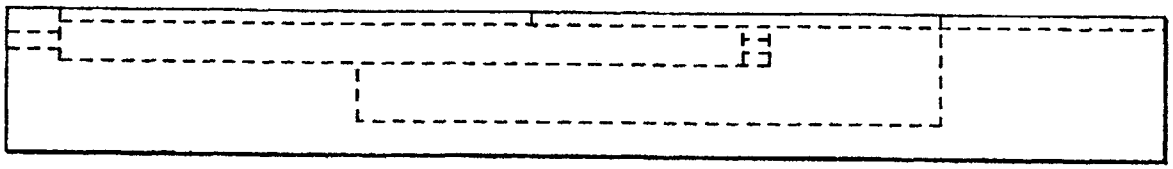
Figure 17C:
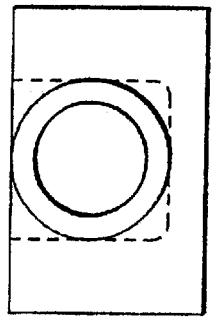
FIGS. 17A and 17E illustrate various orthogonal views of the slide bushings.
Figure 17E:
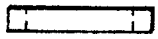
Figure 18B:
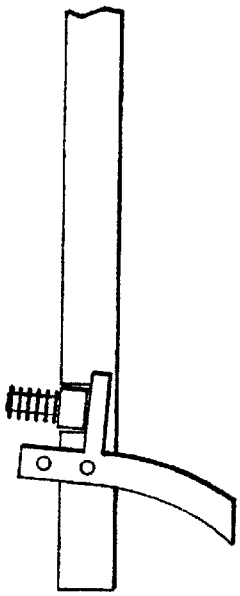
FIGS. 18A and 18B illustrate the trigger bar and an associated lock and plunger mechanism.
Figure 17B:
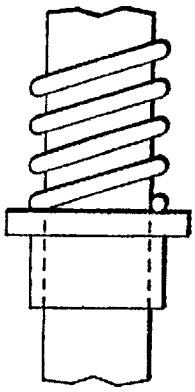
Figure 17D:
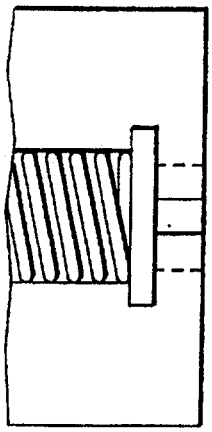
Figure 18A:
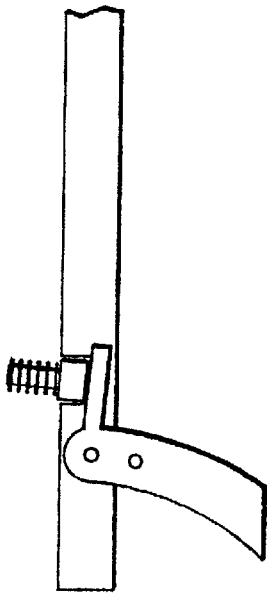
Figure 17A:
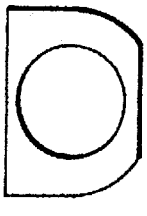

FIGS. 9A and 9B illustrate another alternative embodiment of the invention 600 in which the transfer disk 602 also includes a plurality of teeth 601 on the periphery thereof. A slide 604 supports a spring guide rod 606 which has mounted thereon a plurality of pins or teeth 612 and also supports the recoil spring 608 for the slide 604. A spring-loaded stop 610 is located on the rod 606 and is biased by recoil spring 608. A machine screw 614 holds the distal end of the spring guide rod 606 in position. Recoil causes the pin teeth 612 to chive the disk teeth 601. When the disk 602 gets to the 90° position; it operates in a manner similar to that described in FIGS. 8A–8C FIGS. 10A–18B illustrate detail subassembly views and element views to further assist in the understanding of the basic mechanism.

The invention just described provides a number of significant advantages over prior art firearms having horizontal magazines and rotatable transfer disks. In particular, the invention is substantially less likely to jam or malfunction because of the synergy between the magazine and the transfer disk. The magazine, with the end cap, especially if combined with a spring-loaded flap or guide mechanism, prevents cartridges from being presented to the rotatable transfer disk until specifically ejected by the injector lever mechanism. Therefore, loose cartridges presenting themselves at random to the rotatable transfer disk cease being a problem. Also, and most importantly, the rotatable transfer disk is prevented from traveling beyond the 90° transfer position by a variety of reliable mechanisms thereby preventing jamming or malfunctions during the critical transfer function. The foregoing advantages all combine to improve the overall safety and reliability of the weapon thereby benefiting the user and the general public.

While the invention has been described with reference to the preferred embodiment thereof, it will be appreciated by those of ordinary skill in the art that various modifications can be made to the structure and elements of the invention without departing from the spirit and scope thereof.

What is claimed is:

1. In an improved magazine and feed mechanism for firearms having a housing defining a barrel extending longitudinally there along, a means for holding a magazine mounted thereon and adapted to hold a plurality of cartridges extending laterally with respect to the housing and positioned to be urged from the magazine in successively following order outwardly through a cartridge outlet defined therein, a transfer disk rotatably mounted within the housing and including a cartridge receiving slot adapted to receive successive cartridges oriented laterally one at a time from the magazine positioned thereadjacent, the transfer disk being rotatable between a laterally oriented cartridge receiving position and the longitudinally oriented cartridge supplying position, and a rail member longitudinally movable between a forward position adjacent the barrel to a rearward position spatially disposed away from the barrel and a cartridge injector for transferring cartridges from said magazine to said transfer disk, the improvement comprising:

a non-resilient end cap means (16) located adjacent to said cartridge outlet (18) on said magazine (20) for preventing cartridges (24) in said magazine (20) from passing through said cartridge outlet (18) unless under the influence of said injector (52).

2. The improvement of claim 1 further comprising:

leaf spring means (28) located within said end cap (16) to urge cartridges (24) away from said cartridge outlet (18).

3. The improvement of claim 1 further comprising:

spring-loaded means (30) located adjacent to said cartridge outlet (18) to bias cartridges (24) away from said cartridge outlet (18).

4. The improvement of claim 1 wherein said magazine (20) includes a slot (32) therein located adjacent to said cartridge outlet (18) for permitting said injector (52) to contact cartridges (24) inside of said magazine.

5. The improvement of claim 4 wherein said slot (37) has a generally "T" shape and the head of said injector (34) has a complimentary "T" shape.

6. The improvement of claim 1 further comprising:

a flap means (36) for covering said cartridge outlet (18); and, a spring means (38) for biasing said flap means (36) into a normally closed position to cover said cartridge outlet (18), wherein said flap means (36) is forced open when said magazine is placed in said firearm against the pressure of said spring means (38) thereby permitting cartridges (24) in said magazine to be transferred through said cartridge outlet to said transfer disk.

7. The improvement of claim 1 further comprising:

magazine latch means (86, 90, 104, 106) for holding said magazine (82) in position on said firearm and for selectively unlocking said magazine from said firearm, said latch means (86, 90, 104, 106) comprising a "C" shaped element that includes a first end (74) for locking said magazine in position and a second end (80) for urging said magazine away from said firearm when said latch is unlocked.

8. The improvement of claim 1 further comprising:

transfer disk drive means for rotating said transfer disk substantially 90°; and, transfer disk over travel prevention means for preventing said transfer disk from rotating substantially beyond 90°.

9. The improvement of claim 8 wherein said transfer disk drive means comprises at least three pins (212, 214, 216) located on said transfer disk (202) which interact with projections and indentations (218, 220, 222) on said rail member (206) and wherein at least two of said pins (214, 216) on said transfer disk (202, 204) contact said rail member (206) after said transfer disk (202) has rotated 90° thereby assisting in preventing the disk (202, 204) from traveling beyond 90°.

* * * * *